United States Patent [19]

Kardas

[11] Patent Number: 4,958,619

[45] Date of Patent: Sep. 25, 1990

[54] PORTABLE, FLUELESS, LOW NOX, LOW CO SPACE HEATER

[75] Inventor: Alan Kardas, Chicago, Ill.

[73] Assignee: Institute of Gas Technology, Chicago, Ill.

[21] Appl. No.: 353,790

[22] Filed: May 18, 1989

Related U.S. Application Data

[63] Continuation-in-part of Ser. No. 222,062, Jul. 8, 1988, Pat. No. 4,846,679.

[51] Int. Cl.[5] ..... F24C 3/00

[52] U.S. Cl. ..... 126/85 R; 126/110 B; 126/110 C; 431/352

[58] Field of Search ..... 431/352, 10; 126/110 B, 126/110 C, 85 R

[56] References Cited

U.S. PATENT DOCUMENTS

| | | | |
|---|---|---|---|
| 1,910,735 | 5/1933 | Zikesch | 431/352 |
| 2,971,480 | 2/1961 | Sage . | |
| 3,689,040 | 9/1972 | Reich . | |
| 3,838,652 | 10/1974 | Schol . | |
| 3,865,538 | 2/1975 | Quigg | 431/352 |
| 3,915,619 | 10/1975 | Quigg et al. | 431/10 |
| 3,936,275 | 2/1976 | Perret et al. . | |
| 4,082,497 | 4/1978 | Crawford et al. . | |
| 4,105,013 | 8/1978 | Vache . | |
| 4,192,284 | 3/1980 | Vache . | |
| 4,340,362 | 7/1982 | Chalupsky et al. . | |
| 4,488,869 | 12/1984 | Voorheis . | |
| 4,507,075 | 3/1985 | Buss et al. | 431/352 |
| 4,565,137 | 1/1986 | Wright . | |
| 4,671,192 | 6/1987 | Hoffert et al. . | |

OTHER PUBLICATIONS

Lionel, T., R. J. Martin and N. J. Brown, "A Comparative Study of Combustion in Unvented Space Heating Devices", Lawrence Berkeley Laboratory, University of California, Applied Science Division, presented at the Western States Section/The Combustion Institute 1984 Fall Meeting, Stanford University, Stanford, Calif., Oct. 22–23, 1984.

*Primary Examiner*—Carroll B. Dority

[57] ABSTRACT

A flueless, portable low nitrogen oxides emissions, low carbon monoxide emissions space heater having a fuel chamber with a fuel inlet and a fuel distributor. The fuel inlet generates a swirling fuel flow within the fuel chamber. A primary air inlet generates a counter-swirling primary airflow with respect to the swirling fuel flow in a primary air chamber. The fuel distributor discharges the swirling fuel flow into the counter-swirling primary airflow thus forming a fuel/air mixture. An ignitor ignites the fuel/air mixture. A combustion chamber is sealably secured to and in communication with the primary air chamber. The combustion chamber wall has a plurality of secondary air supply holes. An intermediate shell surrounds the combustion chamber wall and forms a space between the intermediate shell and the combustion chamber wall. A secondary air inlet is in communication with the space between the intermediate shell and the combustion chamber wall. An outer protective shell surrounds the intermediate shell. A top ring plate is sealably secured to the top portions of the combustion chamber, the intermediate shell and the outer protective shell.

17 Claims, 1 Drawing Sheet

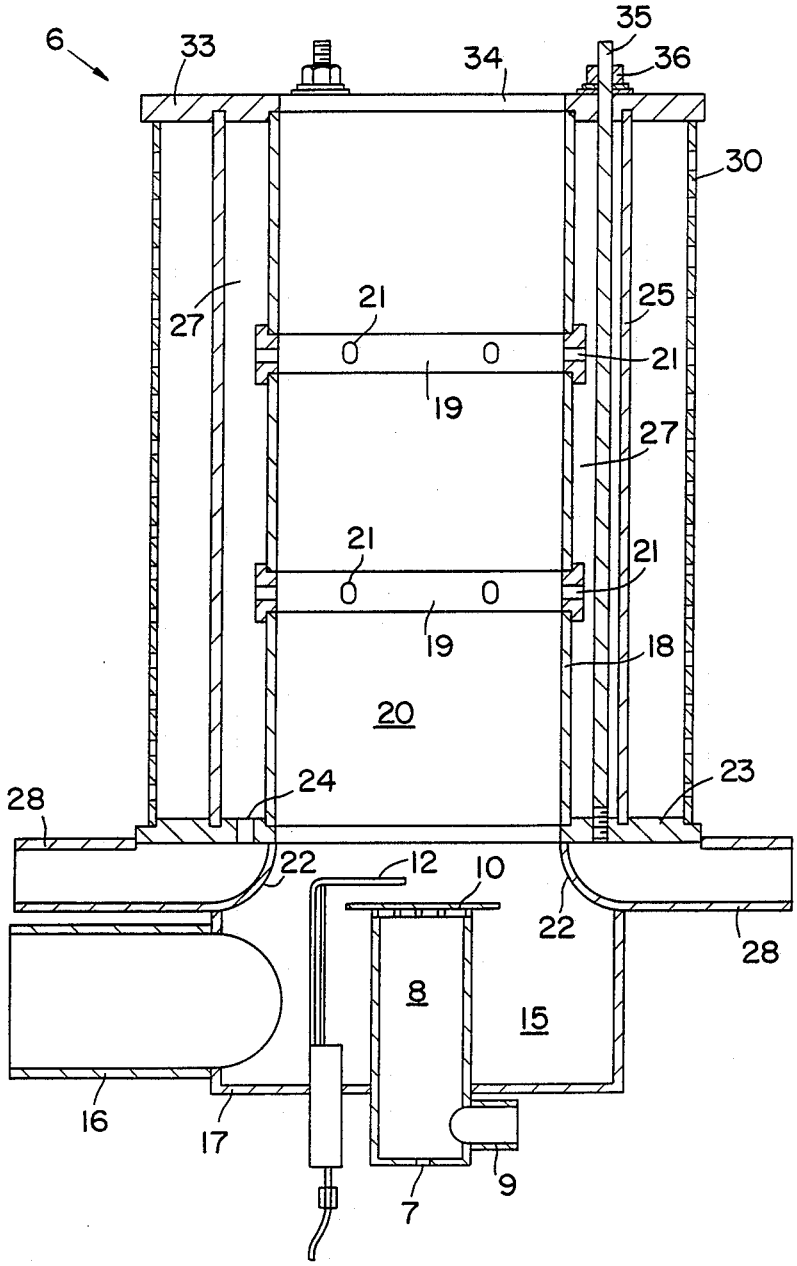
6
33
34
35
36
30
27
21
25
21
19
27
21
21
19
18
20
24
23
28
22
12
10
22
28
8
15
16
17
7
9

PORTABLE, FLUELESS, LOW NOX, LOW CO SPACE HEATER

CROSS REFERENCE TO RELATED APPLICATION

This application is a continuation-in-part of pending application having Ser. No. 07/222,062, and Filing Date July 8, 1988, which has a Notice of Allowance and Issue Fee Due that was mailed Feb. 15, 1989 and now Pat. No. 4,846,679.

BACKGROUND OF THE INVENTION

1. Field of the Invention

A portable, flueless, low nitrogen oxides, low carbon monoxide space heater in which a swirling fuel flow mixes with a counter-swirling primary airflow, with respect to the swirling fuel flow, to form an intimately mixed fuel/air mixture. The flueless space heater admits secondary air into an upper portion of the combustion chamber for additional quenching, continuous combustion, and dilution, thus significantly reducing or eliminating nitrogen oxides and carbon monoxide emission.

2. Description of the Prior Art

The basic principles used to reduce or eliminate nitrogen oxides and carbon monoxide emissions through combustion, quenching, post burning, and dilution are known to the art. Burned with theoretical quantity of air, a methane-type gaseous fuel having a combustion temperature of approximately 3450° F. and an ignition temperature of approximately 1200° F. will produce dangerously high levels of nitrogen oxides in an uncontrolled burning situation. Given such conditions, an unvented space heater will produce high levels of nitrogen oxides. In comparison, kerosene vapors surrounding a wick in a similar unvented, portable space heater will ignite at approximately 700° F. The low ignition temperature of kerosene vapors effectively inhibits formation of nitrogen oxides in such heaters.

In large industrial-type applications, an operating engineer has the freedom to control and adequately mix a fuel and oxidant, providing the residence or burnout time, and the staged quenching necessary to satisfy the theoretical requirements of low nitrogen oxides produced by conventional means. However, it is not immediately apparent that the low emissions of nitrogen oxides in kerosene wick-type heaters can be duplicated by a natural gas or other gaseous fuel burning appliances having a similar design, size and rating.

Reich, U.S. Pat. No. 3,689,040 teaches a low carbon monoxide, high heat output, portable gas heater of the type swept by a high velocity airstream. The gas burner may introduce fuel gas obliquely to provide a fuel swirl in a primary combustion chamber. Air is drawn into the primary combustion chamber through holes in a peripheral chamber wall. A downstream secondary combustion chamber is formed by a conical flange extending from the open end of the primary combustion chamber. A baffle plate extends over a large portion of the flange opening with secondary combustion air being admitted through holes in the flange. The holes are spaced outwardly from the baffle. If natural gas is used as a fuel, a further circle of smaller holes is provided at or near the edge of the baffle. The Reich patent teaches two-stage combustion but does not disclose a counter-swirling introduction of primary combustion air to mix with the fuel. The Reich patent does not teach any decrease in nitrogen oxides emissions.

The Reich patent teaches a space heater of the type typically used at construction sites. Such space heaters are normally rated at approximately 750,000 BTU/hr on propane and approximately 440,000 BTU/hr on natural gas. A space heater according to this invention, typically is natural gas fired at approximately 18,000 BTU/hr. The Reich patent teaches an upstream air fan and a 21½" diameter housing rated at 5,000 cfm. Such air flow, within a heater according to the Reich patent, has a Reynolds number of approximately 360,000 which relates to highly turbulent flow.

According to the invention of this specification, the portable space heater has a Reynolds number of approximately 1,300 which relates to laminar flow; a turbulent regime begins at a Reynolds number approximately equal to 2,300. Thus a space heater according to the Reich patent could not practically be scaled down across the change in flow regimes, nor could the space heater of this invention be scaled up to burn approximately 440,000 BTU/hr as taught by the Reich patent. Reynolds numbers are often used to compare relative sizes of space heaters. The invention according to the Reich patent, and the invention of this application differ in Reynolds numbers by a factor of approximately 280. More importantly, the invention according to the Reich patent operates in a turbulent flow regime whereas the invention of this application operates in a laminar flow regime.

Hoffert et al, U.S. Pat. No. 4,671,192 discloses a pressurized cyclonic combustion method and a cylindrical burner apparatus for pressurized combustion of particulate solid fuels. The Hoffert et al patent teaches a primary combustion chamber which is designed to withstand 3,000° F. A stoichiometric or above quantity of air is supplied and the expected flue gas temperature before quenching is 2700–2800° F. According to the teachings of the Hoffert et al patent, a burner will generate unexceptable levels, relative to current statutory regulations, of nitrogen oxides unless a chemical scrubber is used. The burner according to the teachings of the Hoffert et al patent can not be driven by reducing primary air to sub-stoichiometric quantities and then increasing the quantity of quench air since it is not designed to handle combustion in a post-quench zone where carbon monoxide from the primary chamber would have to be burned out. Quenching according to the teachings of the Hoffert et al patent is determined by metallurgy considerations. According to Table I of the Hoffert et al patent, the Reynolds number in the combustion chamber is about 400,000 and the Reynolds number at the auxiliary air inlet is about 4,000,000. The invention of this application operates at a Reynolds number of approximately 1300 and thus is designed in a different manner.

Schol, U.S. Pat. No. 3,838,652 teaches a furnace installation for burning liquid or gaseous fuel. The furnace installation is particularly designed for boilers. The flame within the furnace is cooled by means of the flue gas mantle enveloping it without the necessity of first mixing the flue gases with combustion air.

Perret et al, U.S. Pat. No. 3,936,275 discloses a method and apparatus for combustion of liquid sulfur in a combustion chamber. The liquid sulfur enters the combustion chamber as a fine spray at the apex of a conical end wall of the combustion chamber. The fine spray is driven into contact with the conical end wall due to whirling action of the primary air. Secondary air is introduced along the lateral walls of the combustion chamber in order to protect such lateral walls from radiation heat produced during combustion.

Crawford et al, U.S. Pat. No. 4,082,497 teaches a high capacity, quiet burner for a hot air heating system used in heating the top and bottom ends of a plastic coated carton, or the like. Chalupsky et al, U.S. Pat. No. 4,340,362 teaches a portable space heater having an outlet at one end of the combustion chamber which is fitted with a conical shaped cone supported therein which traps and causes secondary combustion of a volatized admixture of fuel and air and prevents flames from shooting directly out the end of the combustion chamber.

Wright, U.S. Pat. No. 4,565,137 teaches a bio-mass suspension burner for use with furnaces or boilers. The burner includes a delivery system for injecting particulate solid fuel into a combustor. A primary air stream mixes with the fuel and conducts the mixture into the combuster where secondary air is introduced at the point of ignition. Tertiary air is introduced tangentially to maintain a cyclonic vortex. Sage, U.S. Pat. No. 2,971,480 teaches a cyclone furnace for burning ash-containing solid fuel.

Voorheis, U.S. Pat. No. 4,488,869 teaches a high efficiency, low nitrogen oxides emitting, staged combustion burner for gaseous, liquid or pulverized solid fuels. The burner is self-contained and primarily used in smaller furnaces, as opposed to large industrial furnaces, which provide low nitrogen oxides by staged combustion with introduction of swirling primary air and introduction of fuel straight along the central axis of the main combustion chamber which is in the self-contained burner. The self-contained burner also introduces secondary air at its downstream end in a direction to converge on its axis and to also provide a spin, the combination maintaining a cylindrical-shaped flame. Primary air is introduced at about 75 percent of a stoichiometric quantity and a provision is made for a short residence time in the primary combustion zone which is entirely within the burner basket.

Vache, U.S. Pat. No. 4,105,013 teaches a portable stove having a replaceable pressurized combustible gas cartridge, a burner head, and framework for supporting a cooking vessel. Vache, U.S. Pat. No. 4,192,284 also teaches a portable stove fueled by pressurized gas.

A publication by Lawrence Berkeley Laboratory, University of California, Applied Science Division, "A Comparative Study of Combustion in Unvented Space Heating Devices", by T. Lionel, R.J. Martin and N.J. Brown, presented at the Western States Section/The Combustion Institute 1984 Fall Meeting, Stanford University, Stanford, Calif., Oct. 22–23, 1984, teaches wi-ok-kerosene heaters and compares multi-stage, radiant, and convective configurations. The publication relates primarily to kerosene heaters and the concentrations of nitrogen oxides and carbon monoxide emissions associated with such kerosene heaters.

SUMMARY OF THE INVENTION

It is an object of this invention to provide a flueless, portable space heater having relatively low and safe levels of nitrogen oxides and carbon monoxide emissions.

It is another object of this invention to provide a flueless, portable space heater with initial combustion occurring at relatively low temperatures thereby preventing the formation of nitrogen oxides.

It is yet another object of this invention to provide a flueless, portable space heater having a swirling fuel flow mixing with a counter-swirling primary airflow, with respect to the swirling fuel flow to produce thoroughly mixed fuel and primary air.

It is yet another object of this invention to provide a flueless, portable space heater which reduces the initial combustion temperature by introducing primary air at a less-than-stoichiometric quantity of primary air.

The above objects of this invention relate to current statutory and regulatory environmental requirements. The presence of carbon monoxide in combustion products relates to unused fuel and a danger to the environment. Nitrogen oxides do not have the same toxicity characteristics as carbon monoxide but nitrogen oxides also present environmental dangers.

Relatively low combustion temperatures, approximately 2200° F. for natural gas, produce approximately 100 ppm of carbon monoxide but no nitrogen oxides. At 3,000° F. carbon monoxide is not produced but approximately 25 ppm of nitrogen oxides are generated. At a theoretical combustion temperature of approximately 3,450° F., it is apparent that formation of carbon monoxide may be inhibited merely by supplying enough air. In order to inhibit formation of nitrogen oxides, special methods must be employed.

Carbon monoxide produced early in the combustion reaction can be burned to carbon dioxide by supplying additional air. Once nitrogen oxides are formed, the nitrogen and oxygen persists. Chemical clean-up methods are costly and impractical for use in domestic appliances such as a flueless, portable space heater according to this invention.

The flueless, portable space heater of this invention has an elongated fuel chamber with at least one fuel inlet and an open end with a fuel distributor. The fuel inlet has a configuration and is positioned to generate a swirling fuel flow within the fuel chamber. The fuel chamber is sealably secured to an elongated primary air chamber in a position such that the fuel distributor extends into the primary air chamber.

The primary air inlet of the primary air chamber has a configuration and is positioned to generate a counter-swirling primary airflow, with respect to the swirling fuel flow. The fuel distributor discharges the swirling fuel flow from the fuel chamber into the counter-swirling primary airflow thus forming a thoroughly mixed fuel/air mixture. An igniter ignites the fuel/air mixture causing initial burning or combustion within a combustion chamber.

An elongated combustion chamber is sealably secured to and in communication with the primary air chamber. A plurality of secondary air supply holes are located in the combustion chamber wall. An intermediate shell is spaced from and surrounds the combustion chamber wall, forming an annular space. A secondary air inlet allows secondary air to pass through the annular space formed by the intermediate shell and the combustion chamber wall.

In one embodiment, an outer protective shell having perforated walls is spaced from and surrounds the intermediate shell. A top ring plate is sealably secured to the top portions of the combustion chamber wall, the intermediate shell and the outer protective shell. The combustion products exit the combustion chamber through the hole within the top ring plate. In a preferred embodiment of this invention, the fuel chamber has a cylindrical shape. Each fuel inlet has at least one fuel inlet tube sealably secured to the fuel chamber wall and the centerline of each fuel inlet tube is positioned at an angle with respect to the radius, of the fuel chamber, which intersects the center of the opening of the fuel inlet tube at the inside surface of the wall of the fuel chamber.

In a preferred embodiment of this invention, the primary air chamber has a cylindrical shape. At least one primary air inlet tube is sealably secured to the primary air chamber wall having its centerline positioned at an angle with respect to a radius, of the primary air chamber, which aligns with the center of the primary air inlet tube so as to cause counter-swirling of the primary air with respect to the swirling of the fuel.

In a preferred embodiment of this invention, the centerline of the secondary air supply hole is disposed at an angle relative to the radius of the combustion chamber which has a radial length equal to the distance from the center of the combustion chamber to the inside surface of the combustion chamber wall and intersects the centerline of the secondary air supply hole. The secondary air inlet has at least one secondary air inlet tube sealably secured to the combustion chamber wall and in communication with the annular space formed between the intermediate shell and the combustion chamber wall.

The igniter has at least one ignition source positioned near the fuel distributor. In a preferred embodiment of this invention, the primary airflow provides approximately 60 percent to 75 percent of the stoichiometric amount of oxygen for complete combustion of the fuel supplied.

The method of generating heat within a flueless, portable space heater according to this invention includes the steps of creating a swirling fuel flow and a counter-swirling primary airflow, with respect to the swirling fuel flow, within the combustion chamber. Introducing the swirling fuel flow and the counter-swirling primary airflow forms a thoroughly mixed fuel/air mixture. The fuel/air mixture is ignited and partial combustion of the fuel/air mixture initially occurs in the combustion chamber. Secondary air is introduced with the remaining fuel/air mixture and combustion products and the remaining fuel/air mixture is then postburned within the combustion chamber.

BRIEF DESCRIPTION OF THE DRAWING

The figure shows a cross-sectional front view taken through the center of a flueless, portable space heater according to one embodiment of this invention.

DESCRIPTION OF THE PREFERRED EMBODIMENTS

The figure shows a cross-sectional front view of flueless, portable space heater 6 according to one embodiment of this invention. Fuel inlet conduit 9 is sealably secured to fuel chamber wall 7 and in communication with fuel chamber 8 defined by wall 7. Fuel distributor 10 is attached to and spaced from the open top of fuel chamber wall 7. In a preferred embodiment of this invention, at least one fuel inlet conduit 9 is sealably secured to fuel chamber wall 7. The centerline of each fuel inlet conduit is positioned at an angle with respect to the radius of fuel chamber 8 which intersects the center of the opening of fuel inlet conduit 9 at the inside surface of fuel chamber wall 7, so as to generate a swirling flow of the fuel within fuel chamber 8. It is apparent that other methods exist for generating a swirling fuel flow within fuel chamber 8, such as sealably securing at least one fuel inlet conduit 9 to fuel chamber wall 7 in such a position that the centerline of fuel inlet conduit 9 is aligned with a radius of fuel chamber 8 and attaching a baffle or deflector within each fuel inlet conduit 9, installing baffles within fuel chamber 8, or by any other suitable method known to the art to create a swirling fuel flow.

Fuel chamber walls 7 extend far enough into primary air chamber 15 such that fuel distributor 10, spaced from the open end of fuel chamber 8, discharges the swirling fuel flow into a counter-swirling primary airflow within primary air chamber 15. At least one primary air inlet conduit 16 is sealably secured to primary air chamber wall 17 in a manner to generate a counter-swirling primary airflow with respect to the swirling fuel flow. It is apparent that various methods exist for generating a counter-swirling primary airflow such as those methods disclosed above for generating a swirling fuel flow.

As fuel distributor 10 discharges the swirling fuel flow into the counter-swirling primary airflow, the fuel breaks down into small jetlets and thus prevents the formation of relatively large pockets of fuel and of oxidant. In one embodiment of this invention, igniter 12 is located within primary air chamber 15 near fuel distributor 10. Igniter 12 ignites the fuel/primary air mixture and initial combustion occurs in the lower portion of combustion chamber 20.

Combustion chamber 20, formed by combustion chamber wall 18, is in communication with primary air chamber 15. Combustion chamber wall 18 extends upward as far as top ring plate 33. Combustion chamber wall 18 has a plurality of secondary air supply holes 21. As shown in the figure, according to a preferred embodiment of this invention, combustion chamber 20 has a circular cross section and a total of twelve secondary air supply holes 21, two rows with each row having six equally spaced secondary air supply holes 21, one secondary air supply hole 21 every 60°. However, combustion chamber 20 can have any cross-sectional shape and any suitable number and/or layout of secondary air supply holes 21. Each secondary air supply hole 21 can have any suitable diametrical dimension.

In a preferred embodiment of this invention, intermediate shell 25 surrounds combustion chamber 20. Intermediate shell 25 extends upward from bottom plate 23 as far as top ring plate 33. As shown in the figure, intermediate shell 25 has a circular cross section and forms a sealed annular space 27 between combustion chamber wall 18 and intermediate shell 25. It is apparent that the shape of annular space 27 varies with different cross-sectional shapes of combustion chamber 20 and intermediate shell 25.

At least one secondary air inlet conduit 28 is sealably secured to bottom plate 23. Secondary air inlet conduit 28 is in communication with annular space 27 through at least one bottom plate through hole 24, as shown in the figure. Secondary air inlet conduit 28 can be in communication with annular space 27 through a ring-shaped manifold sealably secured to bottom plate 23 and in communication with space 27. Secondary air inlet conduit 28 can also have a tubular or channel shape and enter annular space 27 through protective shell 30, intermediate shell 25 and the wall of combustion chamber 20, but preferably secondary air inlet 28 attaches to bottom plate 23.

Protective shell 30 surrounds intermediate shell 25. Protective shell 30 extends upward from bottom plate 23 as far as top ring plate 33. Threaded rod 35 is secured to bottom plate 23 and extends through top ring plate 33. Nut 36 threadedly engages with threaded rod 35 to draw tight and secure top ring plate 33 with respect to bottom plate 23. It is apparent that top ring plate 33 can be secured to the top portions or any intermediate portions of combustion chamber wall 18, intermediate shell 25 and/or protective shell 30, by other methods such as top ring plate 33 having threads which engage with threads on the outside surface of combustion chamber 20, locking clamps between top ring plate 33 and combustion chamber wall 18, or by any other suitable securement means known to the art. It is also apparent that top ring plate 33 can have one top plate through hole 34 having a diametrical dimension suitable for allowing the discharge of combustion products from combustion chamber 20, or top ring plate 33 can be a plate having a plurality of holes or the like which also allow the discharge of combustion products from combustion chamber 20.

Secondary air flows from secondary air inlet conduit 28, through bottom plate through hole 24, annular space 27, and secondary air supply holes 21 into combustion chamber 20. In one embodiment of this invention, an underpressure is created within combustion chamber 20, thus secondary air is drawn into combustion chamber 20 due to exterior atmospheric pressure; however, it is apparent that flueless, portable space heater 6 can also operate by using pressurized secondary air within secondary air inlet conduit 28. The relatively cold secondary air cools walls 22 in the lower portion of combustion chamber 20 and thereby cools the primary air/fuel combustion. The swirling primary airflow within primary air chamber 15 provides convective heat transfer from converging walls 22. In a preferred embodiment of this invention, the centerline of secondary air supply hole 21 has an off-radial slant defined as the centerline of secondary air supply hole 21 disposed at an angle with respect to the radius of combustion chamber 21. Such radius has a radial length from the center of the combustion chamber to the inside surface of combustion chamber wall 18 and such radius intersects the centerline of the secondary air supply hole 21. Preferably, secondary air supply hole 21 has approximately a 30° off-radial slant. Such angled secondary air supply holes 21 provide both quenching of generated products of primary combustion and also supply secondary air for complete combustion of remaining fuel, burnout of carbon monoxide, and the dilution of the combustion products.

The combustion process begins where the thoroughly mixed fuel/primary air mixture is ignited by igniter 12. Primary combustion preferably occurs at a combustion temperature which does not exceed approximately 2200° F. Thus the primary combustion process begins at or near converging area 22 and combustion continues into combustion chamber 20. In a preferred embodiment of this invention, a positive separation of air feeds is used to inhibit formation of nitrogen oxides. In such preferred embodiments, primary air chamber 15 receives approximately 60 to 75 percent of the stoichiometric amount of oxygen for complete combustion of the fuel supplied. Secondary air is admitted through secondary air inlet 28 for secondary combustion or postburning of the carbon monoxide and for diluting the products of combustion. Low temperature primary combustion prevents or reduces the formation of nitrogen oxides emissions. The further controlled process of quenching, secondary combustion, and dilution eliminates or reduces carbon monoxide emissions.

It is generally known that to reduce the formation of thermal nitrogen oxides, the combustion temperature must be kept low and uniform. Thus the combustion flame must be stable and without local temperature gradients and the combustion products must be promptly diluted or quenched. This invention satisfies the requirement of low temperature primary combustion by controlling introduction of a less-than-stoichiometric quantity of primary air. Mixing the swirling fuel flow and counter-swirling primary airflow controls consistent temperatures and avoids high temperature spikes which produce nitrogen oxides. The counter-swirling primary airflow generates an under pressure region into which the fuel stream expands and assures intimate and thorough mixing at the point of ignition. The products of combustion are then continually diluted or quenched by a controlled and graduated secondary airflow.

The counter-swirling of remaining fuel and combustion products induced by the primary counter-swirling airflow moves upward through combustion chamber 20 with continued counter-swirling motion. Depending upon the most effective control for diluting or quenching and postburning, the position along combustion chamber wall 18 of combustion chamber 20, the size and the off-radial slant or angle of at least one secondary air supply hole 21 can be varied. In a preferred embodiment of this invention, the angle of at least one secondary air supply hole 21 is positioned such that secondary air enters combustion chamber 20 with and not against the fluid flow within chamber 20.

The Reich patent teaches fuel injection through a relatively large orifice in a nozzle and further teaches delivery of air through primary air inlets of the combustion chamber. A calculation using data cited in the Reich patent shows that with a 440,000 BTU/hr natural gas input with a 5/16 inch diameter nozzle, the back pressure at the nozzle will be approximately 6–7 in. w.c. As the jet expands, the fuel gas creates enough under pressure in the burner tube to entrain through the holes in the combustion chamber wall more than the stoichiometric quantity of air necessary for complete combustion of the fuel. Thus, nitrogen oxides will form in the primary combustion chamber according to the teachings of the Reich patent and such nitrogen oxides will only be diluted, not eliminated by secondary air. The device according to the Reich patent does not positively control the supply of primary air. Such primary air supply will vary with turndown and the quantity and size of holes in the combustion chamber wall thereby producing high temperatures and rapid formation of nitrogen oxides.

In this invention, primary combustion air deficiency prevents formation of nitrogen oxides and carbon monoxide is eliminated through postburning with secondary air. Flueless, portable space heater 6 according to this invention is capable of generating nitrogen oxides and carbon monoxide in concentrations lower than those currently required by relevant environmental statutes. In a prototype tested by the inventor, less than 10 ppm of nitrogen oxides, air-free dry basis, was achieved; specifically, approximately 2 to 5 ppm of nitrogen oxides, air-free dry basis, was achieved.

Igniter 12 can be a spark plug type igniter, a continuous burning igniter, or have any other suitable igniter design known to the art. Although vaporized liquid fuels will work in flueless, portable space heater 6, gaseous fuels will more thoroughly mix with the counter-swirling primary airflow. Gaseous fuels may include natural gases, propane, butane or the like, preferably methane due to the lower requirement of secondary air for complete combustion. It is apparent that such gaseous fuels can be supplied from bottled LPG, a gaseous fuel wall outlet with which fuel inlet conduit 9 may be in communication, or the like.

As shown in the figure, combustion chamber wall 18 has three sections, each section sealably secured to and separated by ring 19. Multiple sections, as shown in the figure, reduce the overall costs of flueless, portable space heater 6 by reducing the quantity of expensive high-temperature resistant materials. The heat resistant materials and most expensive materials are used close to the highest flame temperature such as the bottom section of combustion chamber wall 18. As the temperature reduces upward within combustion chamber 20, less expensive materials can be used since the wall materials are exposed to lower temperatures. However, it is apparent that combustion chamber 20 can have one continuous combustion chamber wall 18 without any need for rings 19 or any other combination of wall sections.

In a preferred embodiment of this invention, the lower portion of combustion chamber wall 18 which is exposed to the highest temperature can be constructed from any high temperature resistant material such as aluminum oxides or refractories capable of withstanding high temperatures and high and low cyclic temperatures caused by turning the space heater off and on, or can be constructed from any other suitable materials known to the art. The higher sections of combustion chamber wall 18 where the temperature decreases within combustion chamber 20 can be made from materials having lower temperature resistant properties. Since fuel chamber wall 8 and primary air chamber wall 17 are positioned below the combustion zone, lower temperature resistant materials such as carbon steel, galvanized sheet metal or the like can be used. Intermediate shell 25 can be constructed of any material having high thermal conductivity or any material capable of transmitting infrared radiation, such PYREX TM or any other suitable material known to the art. Combustion chamber wall 18 is preferably constructed of a material having low thermal conductivity, relative to the thermal conductivity of metal. Such low conductivity will maintain the high temperature of combustion chamber wall 18 and thereby avoid steep temperature gradients across combustion chamber wall 18. Steep temperature gradients tend to promote formation of nitrogen oxides.

Protective shell 30 prevents contact between a human, an animal, or any other object and the hot surface of intermediate shell 25. Thus protective shell 30 can be constructed from any suitable material known to the art, preferably a stainless steel, wire mesh or stainless steel perforated plate, any of which prevents oxidation or rusting. Other materials and shapes for the structural members described above and other structural members of this invention will become apparent to a person skilled in the art upon reading this disclosure.

Although this specification describes a flueless space heater, it is apparent that a flue stack can be attached or connected to flueless, portable space heater 6 according to this invention. Preferably the space heater is flueless so that the space heater is conveniently portable.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A flueless, portable space heater comprising: a fuel chamber having a fuel inlet and fuel distributing means, fuel swirling means for generating a swirling fuel flow;

a primary air chamber, primary air swirling means for generating a counter-swirling primary air flow with respect to said swirling fuel flow, said primary air swirling means having a cross-sectional area permitting only laminar flow of said counter-swirling primary air flow, said fuel distributing means discharging said swirling fuel flow into said counter-swirling primary air flow forming a fuel/air mixture, ignition means for igniting said fuel/air mixture;

at least one combustion chamber wall forming a combustion chamber sealably secured to and in communication with said primary air swirling means, secondary air inlet means, said combustion chamber in communication with said secondary air inlet means, said secondary air inlet means comprising said at least one combustion chamber wall having a plurality of secondary air supply holes, an intermediate shell surrounding said at least one combustion chamber wall, said intermediate shell forming a space between said intermediate shell and said at least one combustion chamber wall, a top and a bottom sealing said space, a secondary air inlet in communication with said space, said bottom having at least one bottom plate through hole, at least one secondary air inlet tube sealably secured to said bottom and in communication with said at least one bottom plate through hole, each said bottom plate through hole in communication with said space between said intermediate shell and said at least one combustion chamber wall; and an outer protective shell surrounding and supportably spaced from said at least one combustion chamber wall of said combustion chamber.

2. A flueless, portable space heater according to claim 1 wherein each said combustion chamber wall is of refractory material.

3. A flueless, portable space heater according to claim 1 wherein each said combustion chamber wall is of metal having low thermal conductivity.

4. A flueless, portable space heater according to claim 1 wherein said intermediate shell is of a heat-resistant glass.

5. A flueless, portable space heater according to claim 1 wherein said intermediate shell forms an annular space between said intermediate shell and said at least one combustion chamber wall of said combustion chamber, and said intermediate shell extends from said bottom plate to a top plate, said intermediate shell is parallel to said combustion chamber wall, and both said bottom plate and said top plate abut said at least one combustion chamber wall.

6. A flueless, portable space heater according to claim 1 wherein said fuel chamber is cylindrical.

7. A flueless, portable space heater according to claim 1 further comprising: said combustion chamber having a circular cross section, each said secondary air supply hole having a centerline disposed at an angle to the radius of said combustion chamber.

8. A flueless, portable space heater according to claim 7 wherein said angles are approximately 30°.

9. A flueless, portable space heater according to claim 4 wherein said fuel swirling means further comprises: said fuel inlet being at least one fuel inlet tube, each said fuel inlet tube sealably secured to an off-center portion of a fuel chamber wall of said fuel chamber.

10. A flueless, portable space heater according to claim 1 wherein said primary air swirling means further comprises: a cylindrical primary air chamber, at least one primary air inlet tube, and each said primary air inlet tube sealably secured to and in communication with an off-center portion of a primary air chamber wall of said primary air chamber.

11. A flueless, portable space heater according to claim 1 wherein said ignition means is at least one ignition source positioned near said fuel distributing means.

12. A flueless, portable space heater according to claim 1 wherein said primary air swirling means admits primary air into said combustion chamber in a quantity of approximately 60 percent to 75 percent of a stoichiometric requirement for complete combustion of fuel of said fuel flow.

13. A flueless, portable space heater according to claim 1 wherein said at least one combustion chamber wall is of a low conductivity material, relative to the conductivity of metal.

14. A flueless, portable space heater comprising:

a fuel chamber having a fuel inlet and fuel distributing means, fuel swirling means for generating a swirling fuel flow;

a primary air chamber, primary air swirling means for generating a counter-swirling primary air flow with respect to said swirling fuel flow, said fuel distributing means discharging said swirling fuel flow into said counter-swirling primary air flow forming a fuel/air mixture, ignition means for igniting said fuel/air mixture;

at least one combustion chamber wall forming a combustion chamber sealably secured to and in communication with said primary air swirling means, secondary air inlet means, said combustion chamber in communication with said secondary air inlet means; and an outer protective shell having perforated walls surrounding and supportably spaced from said at least one combustion chamber wall of said combustion chamber.

15. A flueless, portable space heater comprising:

a fuel chamber having a fuel inlet and fuel distributing means, fuel swirling means for generating a swirling fuel flow;

a primary air chamber, primary air swirling means for generating a counter-swirling primary air flow with respect to said swirling fuel flow, said fuel distributing means discharging said swirling fuel flow into said counter-swirling primary air flow forming a fuel/air mixture, ignition means for igniting said fuel/air mixture;

at least one combustion chamber wall forming a combustion chamber sealably secured to and in communication with said primary air swirling means, secondary air inlet means, said combustion chamber in communication with said secondary air inlet means; and an outer protective shell having mesh material surrounding and supportably spaced from said at least one combustion chamber wall of said combustion chamber.

16. A flueless, portable space heater according to claim 15 wherein said outer protective shell has perforations.

17. A flueless, portable space heater according to claim 15 wherein said outer protective shell is of mesh material.

* * * * *